US011833386B2

(12) United States Patent
Esco et al.

(10) Patent No.: US 11,833,386 B2
(45) Date of Patent: Dec. 5, 2023

(54) SPOTTING DEVICE FOR SUPPORTING A WEIGHTLIFTING BARBELL

(71) Applicant: The Board of Trustees of The University of Alabama, Tuscaloosa, AL (US)

(72) Inventors: Michael R. Esco, Northport, AL (US); Will Wright, Northport, AL (US)

(73) Assignee: The Board of Trustees of The University of Alabama, Tuscaloosa, AL (US)

( * ) Notice: Subject to any disclaimer, the term of this patent is extended or adjusted under 35 U.S.C. 154(b) by 0 days.

(21) Appl. No.: 17/574,187

(22) Filed: Jan. 12, 2022

(65) Prior Publication Data

US 2022/0219035 A1 Jul. 14, 2022

Related U.S. Application Data

(60) Provisional application No. 63/136,351, filed on Jan. 12, 2021.

(51) Int. Cl.
*A63B 21/078* (2006.01)
*A63B 21/072* (2006.01)

(52) U.S. Cl.
CPC ..... *A63B 21/0783* (2015.10); *A63B 21/0724* (2013.01)

(58) Field of Classification Search
CPC . A63B 21/072; A63B 21/0724; A63B 21/078; A63B 21/0783; A63B 21/08
See application file for complete search history.

(56) References Cited

U.S. PATENT DOCUMENTS 2,470,815 A * 5/1949 Roosevelt ..... A63B 21/075 482/106
3,346,256 A * 10/1967 White ..... A63B 21/0783 482/94
4,799,674 A * 1/1989 Ochab ..... A63B 21/078 482/104
5,468,203 A * 11/1995 Okonkwo ..... A63B 21/078 482/4
2006/0166794 A1* 7/2006 Brown ..... A63B 21/078 482/104
2016/0310816 A1* 10/2016 Horne ..... A63B 23/03516

* cited by examiner

*Primary Examiner* — Sundhara M Ganesan
*Assistant Examiner* — Zachary T Moore
(74) *Attorney, Agent, or Firm* — Meunier Carlin & Curfman LLC

(57) ABSTRACT

Various implementations include a spotting device for supporting a barbell, the spotting device including a base and an arm. The base has a base body with first end and a second end, at least one foot coupled to the second end of the base body, and a base longitudinal axis. The arm has an arm body with a first end and a second end, a coupler coupled to the first end of the arm body, and an arm longitudinal axis. The coupler is couplable to a portion of a barbell. One of the first end of the base body and the second end of the arm body defines a body opening extending partially through the one of the base body or the arm body, and the other of the second end of the arm body and the first end of the base body is slidably disposed within the body opening.

17 Claims, 9 Drawing Sheets

SPOTTING DEVICE FOR SUPPORTING A WEIGHTLIFTING BARBELL

CROSS-REFERENCE TO RELATED APPLICATIONS

This application claims the benefit of U.S. Provisional Patent Application No. 63/136,351, filed Jan. 12, 2021, the contents of which are incorporated herein by reference in their entirety.

BACKGROUND

Many popular weightlifting exercises involve a user being disposed under a barbell loaded with plate weights on a weightlifting bench. There are many benefits to performing muscular strength exercises while disposed under a barbell loaded with plate weights, and these benefits increase with lifting as heavy of a weight as possible over a given number of repetitions (e.g., usually 10 or less). Because of the advantage of lifting progressively heavier weights, there is an increased risk of musculoskeletal injuries and a possibility that a user could get "pinned" under the barbell. Normally, a user has another individual, also known as a spotter, ready to assist with lifting the barbell in case the user gets too exhausted to further lift the barbell or gets "pinned" under the barbell. The spotter serves to ensure the safe completion of a lift. However, many users workout alone without the use of a spotter.

Current products are available on the market that aim to decrease the risks involved with working out without a spotter. Many of these products require bulky expensive systems that constrain the barbell to a large frame and/or include static stops that could interfere with a workout or only hold up the barbell after the user has already been injured. The barbell being constrained makes for a more awkward workout and the large size of such a system occupies a large amount of space. Other products require attachment to the ceiling or include a combination of products, for example one to hold up the barbell and a special weightlifting bench that can be lowered when a user pushes on a pedal with their foot to engage an actuator.

None of the aforementioned products can be easily integrated into a user's preexisting weightlifting set up and/or require power or actuators. Thus, a need exists for a simple spotting device that can effectively protect the user from injuries and being "pinned" under the barbell while not requiring a bulky system, restraining the barbell, or needing actuators or other additional components.

SUMMARY

Various implementations include a spotting device for supporting a weightlifting barbell, the spotting the device including a base and an arm. The base has a base body, at least one foot, and a base longitudinal axis. The base body has a first end and a second end opposite and spaced apart from the first end of the base body. The at least one foot is coupled to the second end of the base body. The arm has an arm body, a coupler, and an arm longitudinal axis. The arm body has a first end and a second end opposite and spaced apart from the first end of the arm body. The first end of the arm body is coupled to the coupler, and the coupler is couplable to a portion of a weightlifting barbell. One of the first end of the base body and the second end of the arm body defines a body opening extending at least partially through the one of the base body or the arm body, and the other of the second end of the arm body and the first end of the base body is slidably disposed within the body opening.

In some implementations, the coupler defines a coupler opening and a central axis. In some implementations, the coupler opening extends through the coupler perpendicularly to the arm longitudinal axis.

In some implementations, the coupler includes two coupler protrusions and a central axis. In some implementations, each coupler protrusion partially extends circumferentially around the central axis of the coupler. In some implementations, the coupler protrusions are biased toward a radially inward position and is urgable toward a radially outward position.

In some implementations, the device further includes a locking pin. The base and the arm each define at least one locking pin opening. Each locking pin is disposable within the at least one locking pin opening of the base and the at least one locking pin opening of the arm such that the arm and the base are coupled by the locking pin. In some implementations, the at least one locking pin opening of the arm extends perpendicularly to the arm longitudinal axis, and the at least one insert opening of the base extends perpendicularly to the base longitudinal axis. In some implementations, the at least one locking pin opening of the one of the base body and the arm body includes at least two openings.

In some implementations, the other of the arm body and the base body includes a radially slidable protrusion. The radially slidable protrusion is biased toward a radially outward position and is urgable toward a radially inward position, and the one of the base body and the arm body defines at least one protrusion opening. In some implementations, the at least one protrusion opening of the one of the base body and the arm body includes at least two protrusion openings. In some implementations, the radially slidable protrusion is biased toward the radially outward position by a spring force.

In some implementations, a guide protrusion extends radially inwardly from the body opening, the other of the arm body and the base body defines a longitudinally extending guide slot, and the guide protrusion is slidably disposable within the guide slot.

In some implementations, the at least one foot extends radially outwardly. In some implementations, the at least one foot includes at least two feet. In some implementations, the at least one foot includes three or more feet.

In some implementations, the coupler opening is circular. In some implementations, the coupler opening has a diameter between 20 mm to 55 mm. In some implementations, the diameter of the coupler opening is 25 mm or more. In some implementations, the diameter of the coupler opening is 28.5 mm or more. In some implementations, the diameter of the coupler opening is 50 mm or more.

In some implementations, the base and arm are slidably coupled between a first position and a second position. The device has a first length as measured from the central axis of the coupler to the at least one foot in the first position and a second length as measured from the central axis of the coupler to the foot in the second position. The first length is at least two feet, and the second length is five feet or less.

In some implementations, an inner surface of the body opening includes a low friction coating.

In some implementations, the device includes a plastic. In some implementations, the device includes a metal.

In some implementations, the device further includes a locking clamp fixedly coupled to the one of the first end of the base body and the second end of the arm body. The locking clamp is releasably couplable to the other of the second end of the arm body and the first end of the base body when the other of the second end of the arm body and the first end of the base body is disposed within the body opening. In some implementations, the locking clamp includes a post clamp.

In some implementations, the base further includes a base hub. The second end of the base body is coupled to the base hub and the at least one foot is coupled to the base hub. In some implementations, the at least one foot is releasably couplable to the base hub. In some implementations, the base hub has a first side wall and a second side wall opposite and spaced apart from the first side wall. The first side wall defines a base hub opening. The second end of the base body is disposed within the base hub opening such that the second end of the base body abuts the second side wall.

In some implementations, the base body has a circular cross-sectional shape in a plane perpendicular to the base longitudinal axis. The arm body has a circular cross-sectional shape in a plane perpendicular to the arm longitudinal axis.

Various other implementations include a system including two or more of the devices disclosed herein.

BRIEF DESCRIPTION OF DRAWINGS

Example features and implementations are disclosed in the accompanying drawings. However, the present disclosure is not limited to the precise arrangements and instrumentalities shown.

DETAILED DESCRIPTION

The devices, systems, and methods disclosed herein provide for a spotting device that includes an arm and a base and is capable of supporting a weightlifting barbell. The arm includes a coupler that is couplable to a sleeve of a barbell. Either the base or the arm defines a body opening that the other of the base or the arm is slidably disposable within such that the spotting device is adjustable to a range of different heights. The spotting device protects a user from being injured or "pinned" under a barbell during free weight exercises. The spotting device can be adjusted to a predetermined minimum height, which is selected to be equal to or greater than the distance from the user and the ground. As the barbell is lowered, the feet of the spotting device contact the ground as the barbell contacts, or prior to the barbell contacting, the user such that the spotting device supports the barbell. Thus, if a user is unable to lift the barbell, the spotting device supports the barbell above the user such that the user does not become "pinned" under the barbell and can remove himself/herself from beneath the barbell. The spotting device can also be used in a system with two spotting devices, one on each sleeve of the barbell, such that the barbell is balanced.

Various implementations include a spotting device for supporting a weightlifting barbell, the spotting the device including a base and an arm. The base has a base body, at least one foot, and a base longitudinal axis. The base body has a first end and a second end opposite and spaced apart from the first end of the base body. The at least one foot is coupled to the second end of the base body. The arm has an arm body, a coupler, and an arm longitudinal axis. The arm body has a first end and a second end opposite and spaced apart from the first end of the arm body. The first end of the arm body is coupled to the coupler, and the coupler is couplable to a portion of a weightlifting barbell. One of the first end of the base body and the second end of the arm body defines a body opening extending at least partially through the one of the base body or the arm body, and the other of the second end of the arm body and the first end of the base body is slidably disposed within the body opening.

Figure 2:
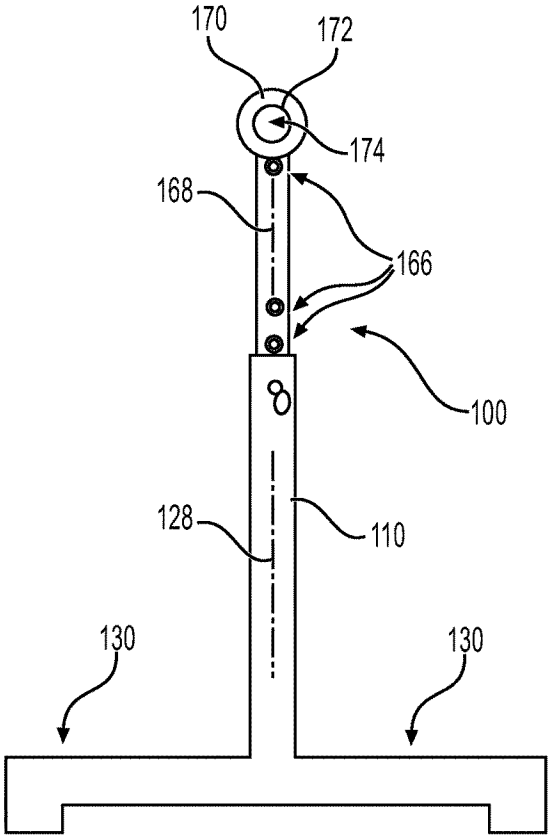
FIG. 2 is a side view of the implementation of one of the spotting devices of the system shown in FIG. 1.
Figure 1:
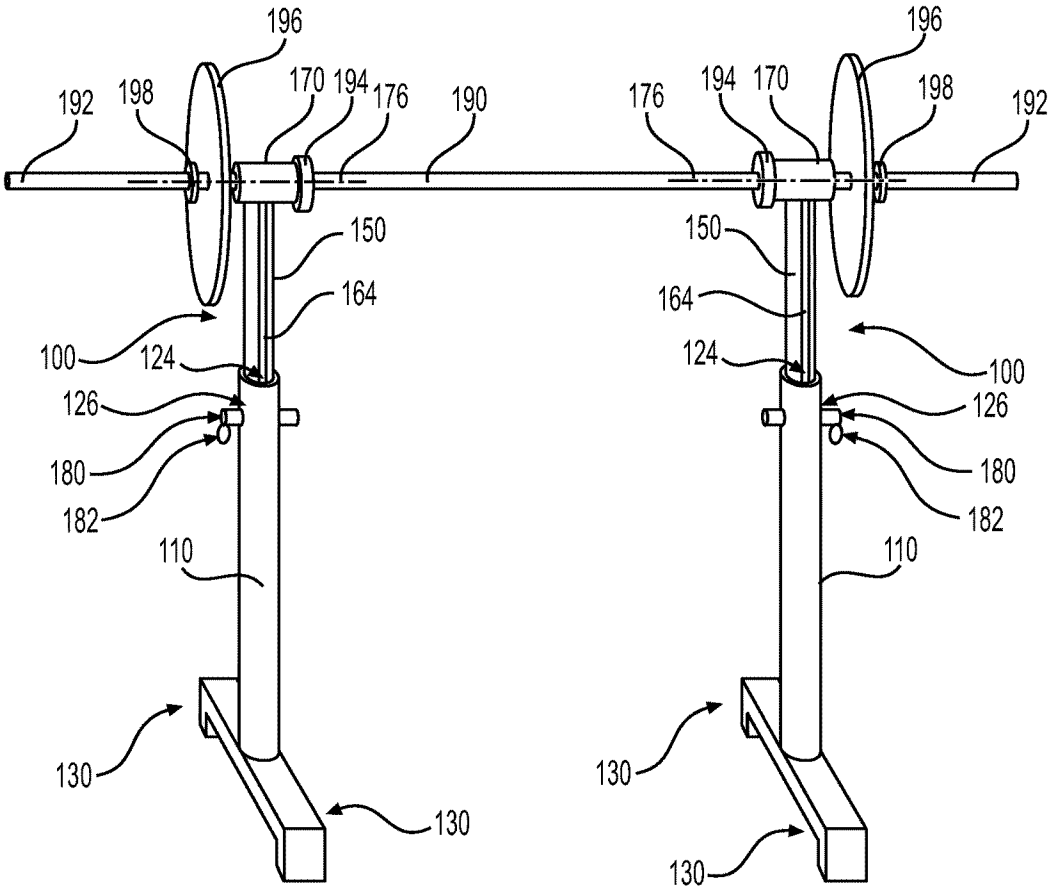
FIG. 1 is a perspective view of a system of spotting devices supporting a weightlifting barbell, according to one implementation.

FIG. 1 illustrates an example of a system of two spotting devices 100 disposed on and supporting a weightlifting barbell 190. FIGS. 2-4 and 11-13 illustrate the same implementation of the spotting device 100. The spotting device includes a base 110, an arm 150, and a locking pin 180.

The base 110 includes a base body 112, two feet 130, and a base longitudinal axis 128. The base body 112 is a cylindrical structure that has an outer surface 114, an inner surface 116, a first end 118, and a second end 120 opposite and spaced apart from the first end 118. The inner surface 116 of the base body 112 defines a body opening 140 that extends along the base longitudinal axis 128 through a portion of the base body 112. The body opening 140 starts at the first end 118 of the base body 112 and extends toward the second end 120 of the base body 112. The inner surface 116 of the base body 112 also includes a base guide 124 that extends radially inwardly from the inner surface 116 of the base body 112 into the body opening 140. The outer surface 114 of the base body 112 further defines a base locking pin opening 126 that extends perpendicularly to the base longitudinal axis through the base body to the inner surface of the base body. In other implementations, the outer surface of the base body defines multiple base locking pin openings, or the base locking pin opening or openings do not extend through the base body.

Although the base body shown in FIGS. 1-4 and 11-13 is cylindrical, in other implementations, the base body is a rectangular, hexagonal, triangular, or any other closed shape prism. While the body opening only extends through a portion of the base body shown in FIGS. 1-4 and 11-13, in other implementations, the body opening extends from the first end of the base body to the second of the base body. In other implementations, the inner surface of the base body does not include a base guide or includes multiple base guides. In other implementations, the inner surface of the body further includes a low friction coating.

Each of the two feet 130 of the base 110 are coupled to the second end 120 of the base body 112 and are disposed opposite each other relative to the base longitudinal axis 128. Each foot 130 includes a first portion 132 and a second portion 134 that are integrally coupled such that the foot 130 is generally "L" shaped. The first portion 132 extends perpendicularly to the base longitudinal axis 128. The second portion 134 extends from the first portion 132 and parallel to the base longitudinal axis 128. The length of the first portion 132 is greater than the length of the second portion 134. In other implementations, the length of the first portion is the same as or less than the length of the second portion. In other implementations, the feet include a first portion but not a second portion.

In some implementations, the base includes one circular foot that extends radially outwardly from the second end of the base body such that it forms a stand to support the base body. In other implementations, the base includes one foot, three feet, or any number of feet to enable the base to stand upright when supporting the barbell. While the feet 130 in the spotting device 100 shown in FIGS. 1-4 and 11-13 are generally "L" shaped, in other implementations, the feet can be curved or in any shape that can effectively support the spotting device when the spotting device is disposed on the ground and is supporting a weightlifting barbell.

The arm 150 of the spotting device 100 includes an arm body 152, a coupler 170, and an arm longitudinal axis 168. The arm body 152 is a cylinder that has an outer surface 154, a first end 158, and a second end 160 opposite and spaced apart from the first end 158. The outer surface 154 of the arm body 152 defines eight arm locking pin openings 166 that extend perpendicularly to the arm longitudinal axis 168 through the arm body 152. The eight arm locking pin openings 166 are axially spaced apart from each other along the arm body 152. The outer surface 154 of the arm body 152 further defines an arm guide slot 164 that starts at the first end 158 of the arm body 152 and extends axially along the outer surface 154 of the arm body 152 to the second end 160 of the arm body 152.

The second end 160 of the arm body 152 is slidably disposed within the body opening 140 of the base 110 such that the arm guide slot 164 is aligned with the base guide 124 and a portion of the arm body 152 is disposed within the body opening 140 of the base 110. The base guide 124 is disposed within the arm guide slot 164 and prevents circumferential rotation of the arm 150 relative to the base 110 such that the arm body 152 is only axially slidable within the body opening 140 of the base body 112.

In other implementations, the outer surface of the arm body defines one, two, three, or more arm locking pin openings. While the arm body shown in FIGS. 1-4 and 11-13 defines an arm guide slot, in other implementations, the outer surface of the arm body does not define an arm guide slot. Also, in other implementations, the arm body is a rectangular, hexagonal, triangular, or any other closed shape prism that corresponds to the shape of the base body.

The first end 158 of the arm body 152 is integrally coupled to the coupler 170, and the coupler 170 is couplable to a sleeve 192 of a weightlifting barbell 190, as illustrated in FIG. 1. The coupler 170 is a tube with an inner surface 172 that defines a coupler opening 174 and has a central coupler axis 176. The coupler opening 174 is circular and extends through the coupler 170 perpendicularly to the arm longitudinal axis 168. The coupler opening 174 also extends perpendicularly to the first portion 132 of the feet 130. The diameter of the coupler opening 174 is 50 mm, although in other implementations, the coupler opening ranges from 25 mm or more, 28.5 mm or more, 50 mm or more, or anywhere within the range of 20 mm to 55 mm. In some implementations, the inner surface of the coupler also includes a low friction coating such that the sleeve of the barbell can be easily inserted through the coupler opening. The coupler 170 is disposed on the sleeve 192 of the barbell 190 between a barbell bearing/bushing 194 and a weight plate 196 such that the central coupler axis 176 and the barbell 190 are coaxial. The spotting device 100 and weight plate 196 are further secured onto the barbell with a clamp 198.

The locking pin 180 is a small cylindrical bar with a loop handle 182. The loop handle 182 allows for easy removal and placement of the locking pin 180. The locking pin 180 is removably disposable within the base locking pin openings 126 and the arm locking pin openings 166.

The base locking pin opening 126 and the arm locking pin openings 166 are alignable. In FIGS. 1-4 and 11-13, the arm 150 and the base 110 are fixedly coupled by the locking pin 180 being disposed within the base locking pin opening 126 and a first arm locking pin opening 166. When the locking pin 180 is removed from the base locking pin opening 126 and the first locking pin opening 166, the arm body 152 is free to be moved axially relative to the base body 112 such that the base locking pin opening 126 can be aligned with another of the arm locking pin openings 166. Once aligned with a second arm locking pin opening 166, the locking pin 180 can be disposed within the base locking pin opening 126 and the second the arm locking pin opening 166 to prevent the axial movement of the arm body 152 relative to the base body 112.

Figure 4:
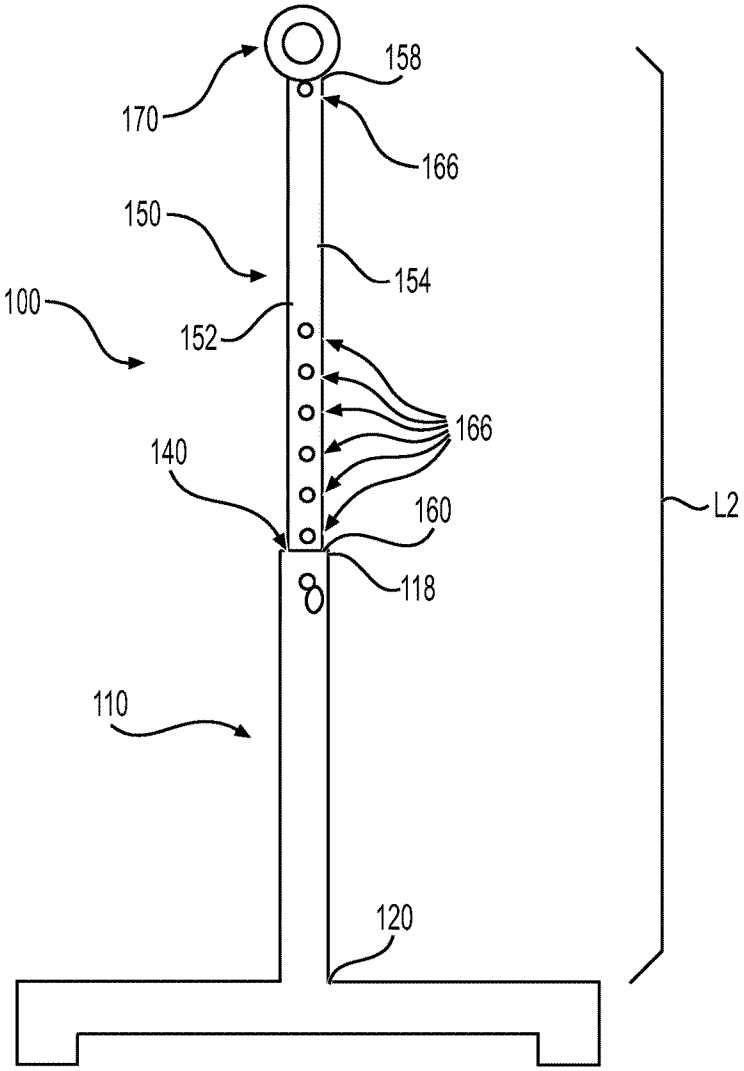
FIG. 4 is a side view of the implementation of one of the spotting devices of the system shown in FIG. 1 fully extended.
Figure 3:
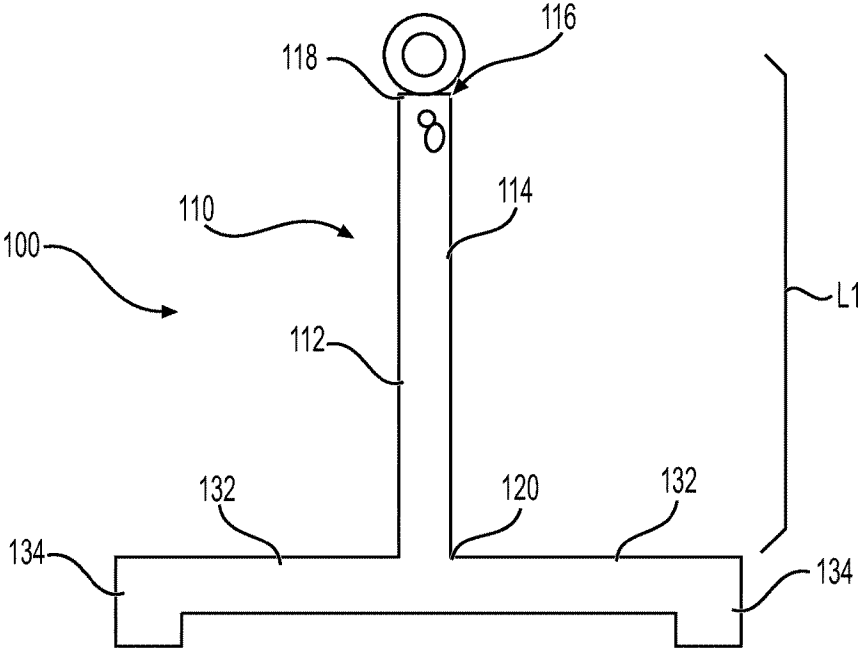
FIG. 3 is a side view of the implementation of one of the spotting devices of the system shown in FIG. 1 not extended.

As shown in FIGS. 3 and 4, the length of the portion of the arm body 152 that is disposed within the body opening 140 of the base 110 is adjustable at increments defined by the arm locking pin openings 166. The height of the spotting device 100, as measured from the central coupler axis 176 to the first portion 132 of the foot 130, can range from a first height L1 to a second height L2 feet depending on the length of the portion of the arm body 152 that is disposed within the body opening 140 of the base 110. The first height L1 of the device 100, as shown in FIG. 3, is two feet, and the second height L2 of the device 100, as shown in FIG. 4, is five feet. However, in other implementations, the L1 can be as low as one foot, and L2 can range anywhere between one foot to five feet.

Figure 6:
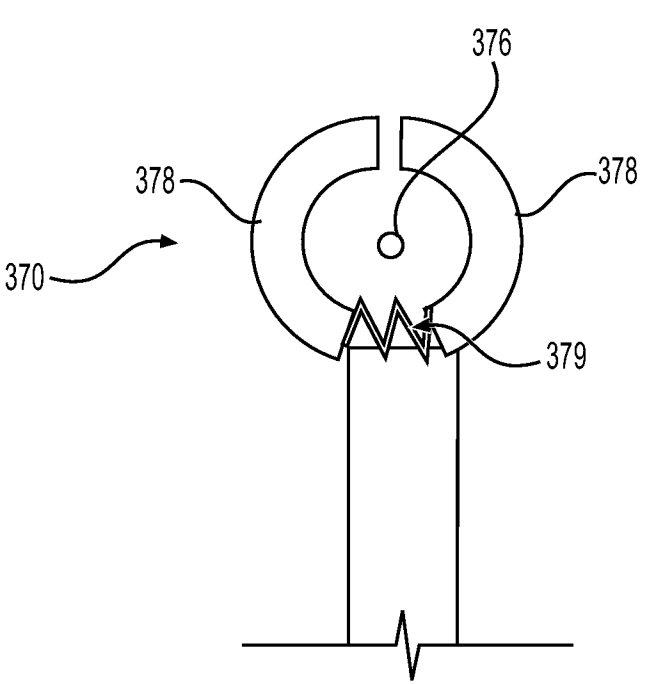
FIG. 6 is a detailed side view of a coupler of a spotting device, according to another implementation.
Figure 5:
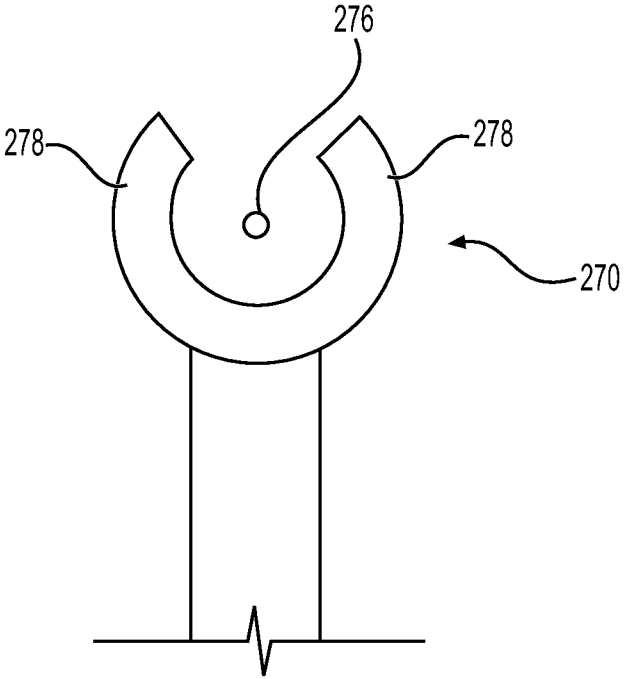
FIG. 5 is a detailed side view of a coupler of a spotting device, according to another implementation.

FIGS. 5 and 6 illustrate two alternative implementations of a coupler 270, 370. In FIG. 5, the coupler 270 includes two coupler protrusions 278 and a coupler central axis 276. The two coupler protrusions 278 are integrally formed and partially extend circumferentially around the central axis 276 of the coupler 270. The two coupler protrusions 278 do not circumferentially extend completely around the central axis 276 of the coupler 270 and can be resiliently urged radially outwardly. A weightlifting barbell 290 can be pressed against the ends of the two coupler protrusions 278 to urge the coupler protrusions 278 radially outwardly such that the barbell 290 can be inserted through the gap and into the coupler 270 coaxial with the coupler central axis 276. Once the barbell 290 is disposed between the coupler protrusions 278, the coupler protrusions 278 resiliently move radially inwardly to retain the barbell.

In FIG. 6, the coupler 370 also includes two coupler protrusions 378 and a coupler central axis 376, but the two coupler protrusions 378 are coupled to each other by a spring 379. The spring 379 biases the coupler protrusions 378 radially inwardly toward a radially inward position, but the coupler protrusions 378 are radially urgable to a radially outward position that compresses the spring 379 such that the barbell 390 can be inserted through the gap and into the coupler 370 coaxial with the coupler central axis 376. Once the barbell 390 is disposed between the coupler protrusions 378, the spring 379 biases the coupler protrusions 378 radially inwardly to the radially inward position to retain the barbell 390.

Figure 8:
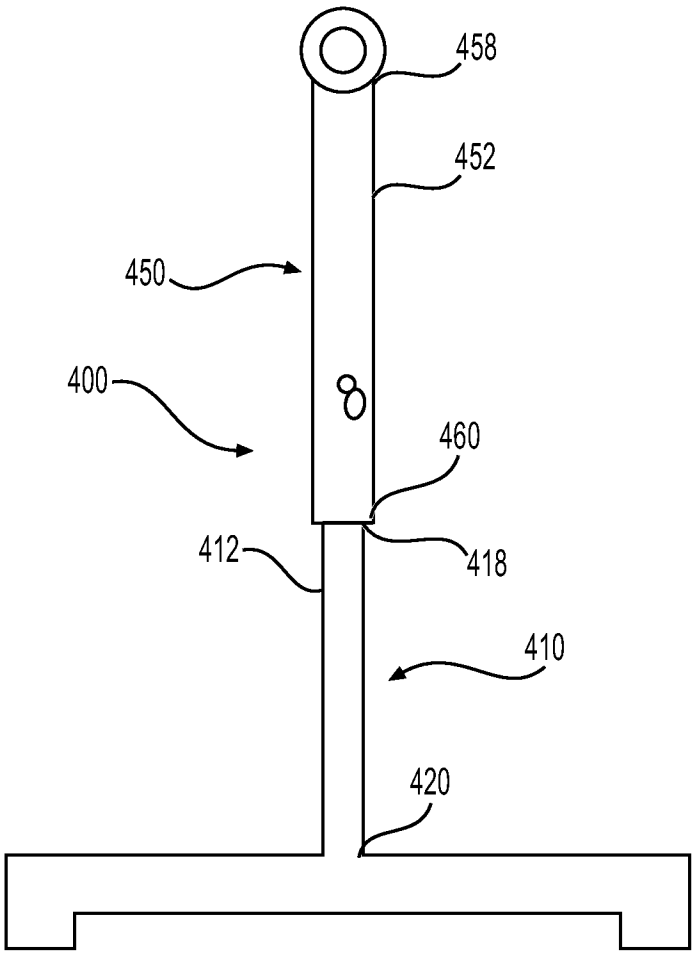
FIG. 8 is a side view of the spotting device shown in FIG. 7.
Figure 7:
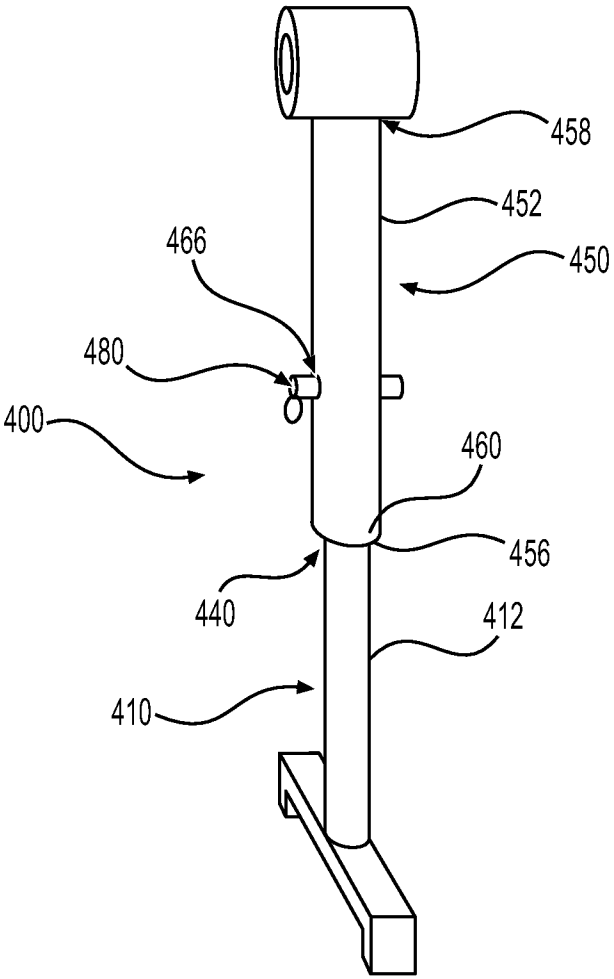
FIG. 7 is a perspective view of a spotting device, according to another implementation.

FIGS. 7 and 8 illustrate another implementation of the spotting device 400 in which the arm body 452 has an inner surface 456 that defines the body opening 440. The body opening 440 starts at the second end 460 of the arm body 452 and extends toward the first end 458 of the arm body 452 along the arm longitudinal axis 468 through a portion of the arm body 452. The first end 418 of the base body 412 is slidably disposed within the body opening 440 of the arm body 452 such that at least a portion of the base body 412 is disposed within the body opening 440 of the arm body 452. The arm locking pin opening 466 is defined by the outer surface 454 of the arm body 452 and extends perpendicularly to the arm longitudinal axis 468 through the arm body 452 to the inner surface 456 of the arm body 452. The outer surface 414 of the base body 412 further defines base locking pin openings 426 (not shown) that extend perpendicularly to the base longitudinal axis 428 through the base body 414 to the inner surface 416 of the base body 412. The locking pin 480 fixably couples the arm body 452 and the base body 412 relative to each other such that at least a portion of the base body 412 is fixably disposed within the body opening 440 of the arm body 452. Although the body opening 440 only extends through a portion of the arm body 452 in the implementation illustrated in FIGS. 7 and 8, in other implementations, the body opening 440 extends from the first end 458 of the arm body 452 to the second end 460 of the arm body 452.

Figure 10:
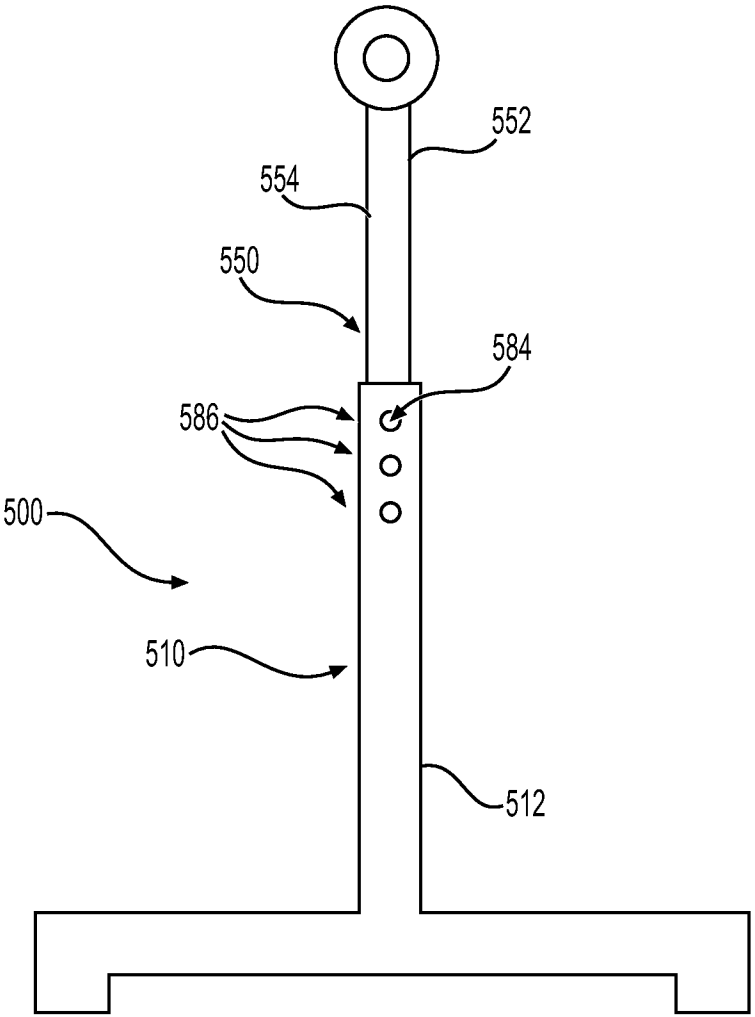
FIG. 10 is a side view of the spotting device shown in FIG. 9.
Figure 9:
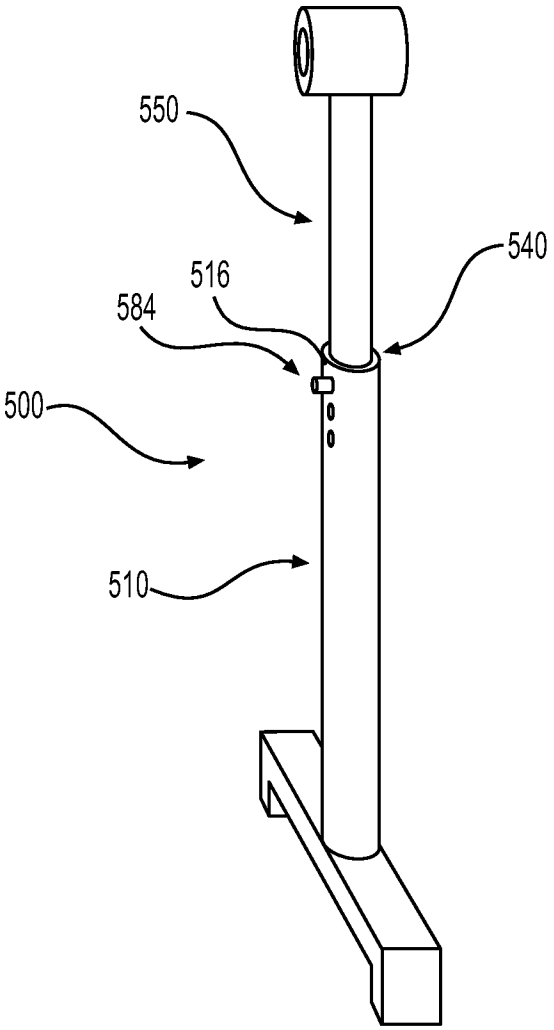
FIG. 9 is a perspective view of a spotting device, according to another implementation.
Figure 13:
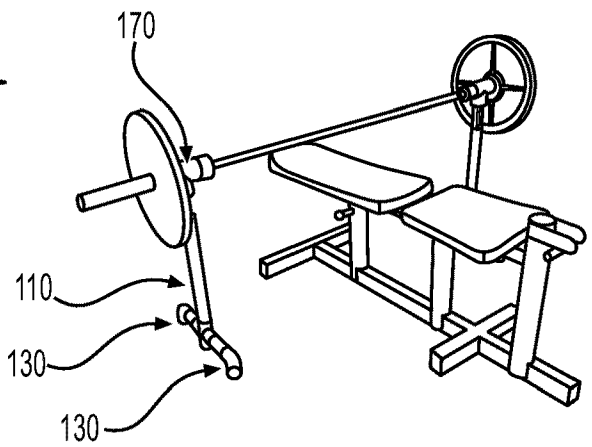
FIGS. 11-13 are perspective views of the system of spotting devices shown in FIG. 1 in use.
Figure 12:
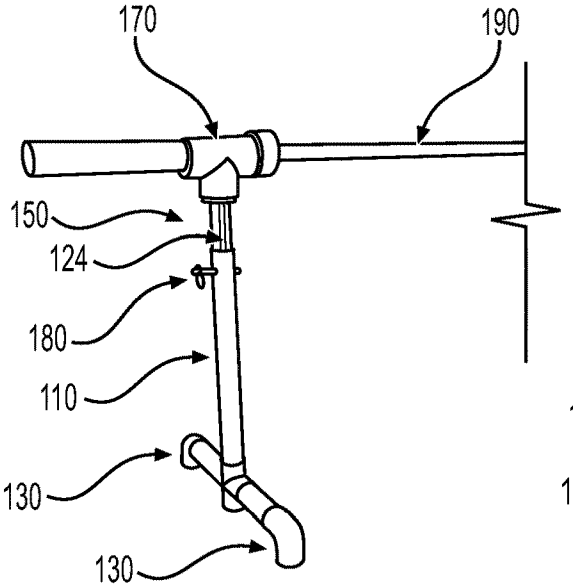
Figure 11:
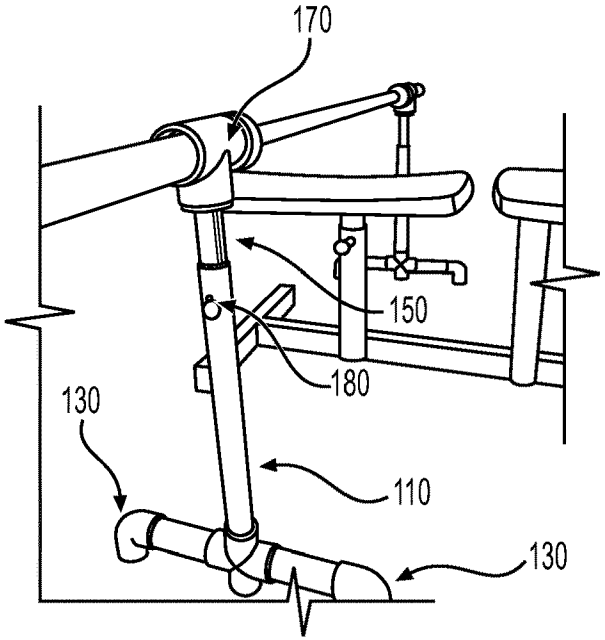
Figure 14:
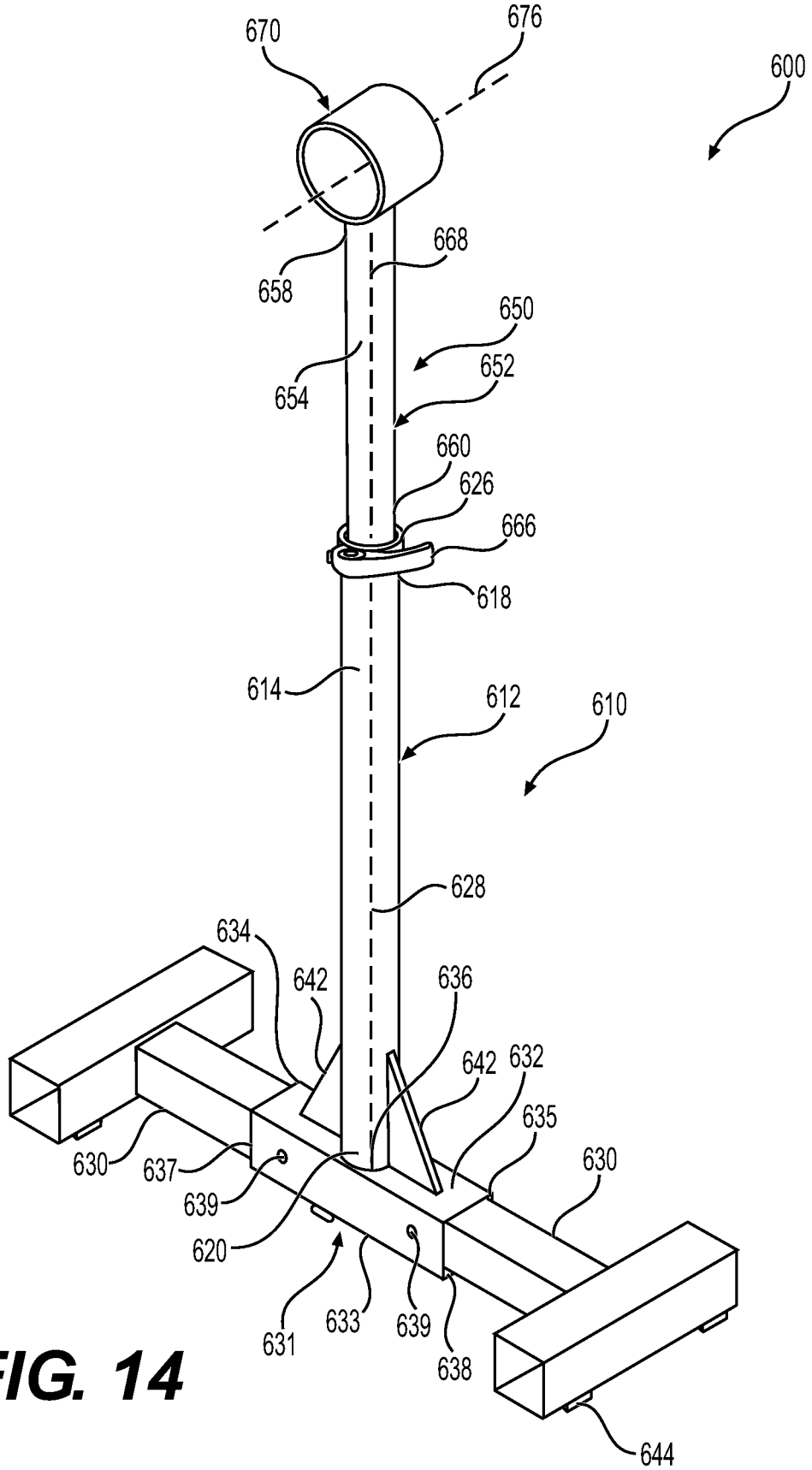
FIG. 14 is a perspective view of a spotting device for supporting a weightlifting barbell, according to another implementation.
Figure 15:
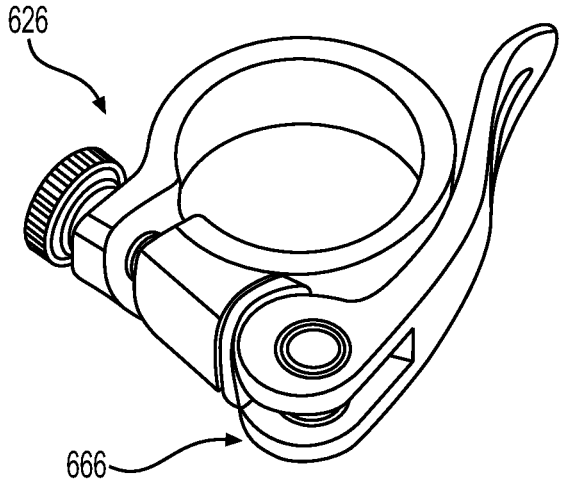
FIG. 15 is a perspective view of the locking clamp of the spotting device of FIG. 14.
Figure 16:
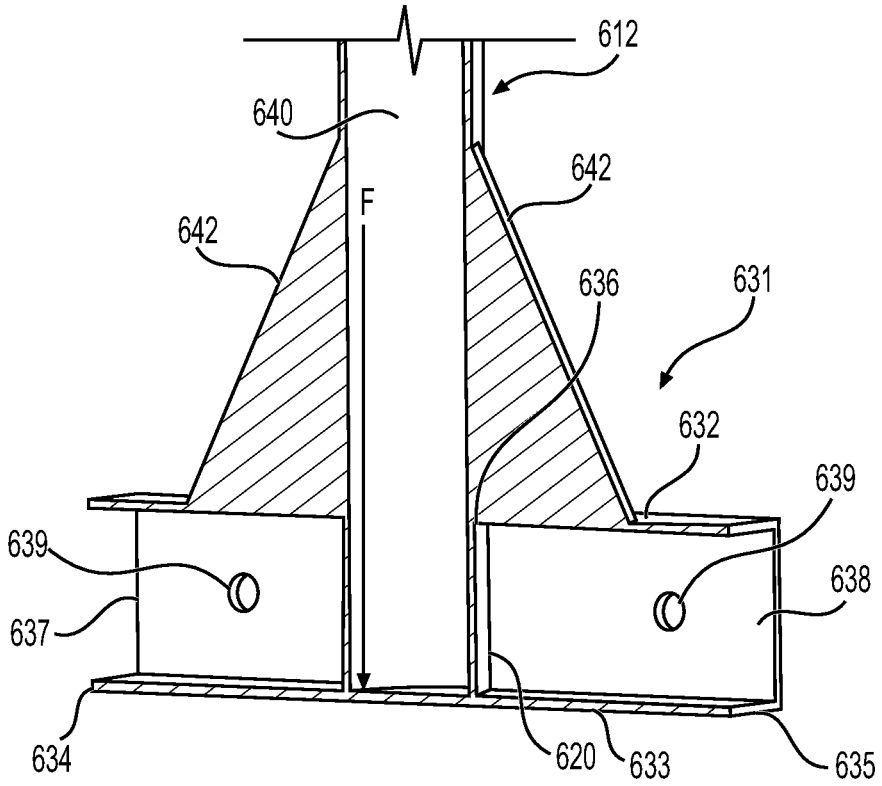
FIG. 16 is a cross-sectional view of the base hub of the spotting device shown in FIG. 14.
Figure 17:
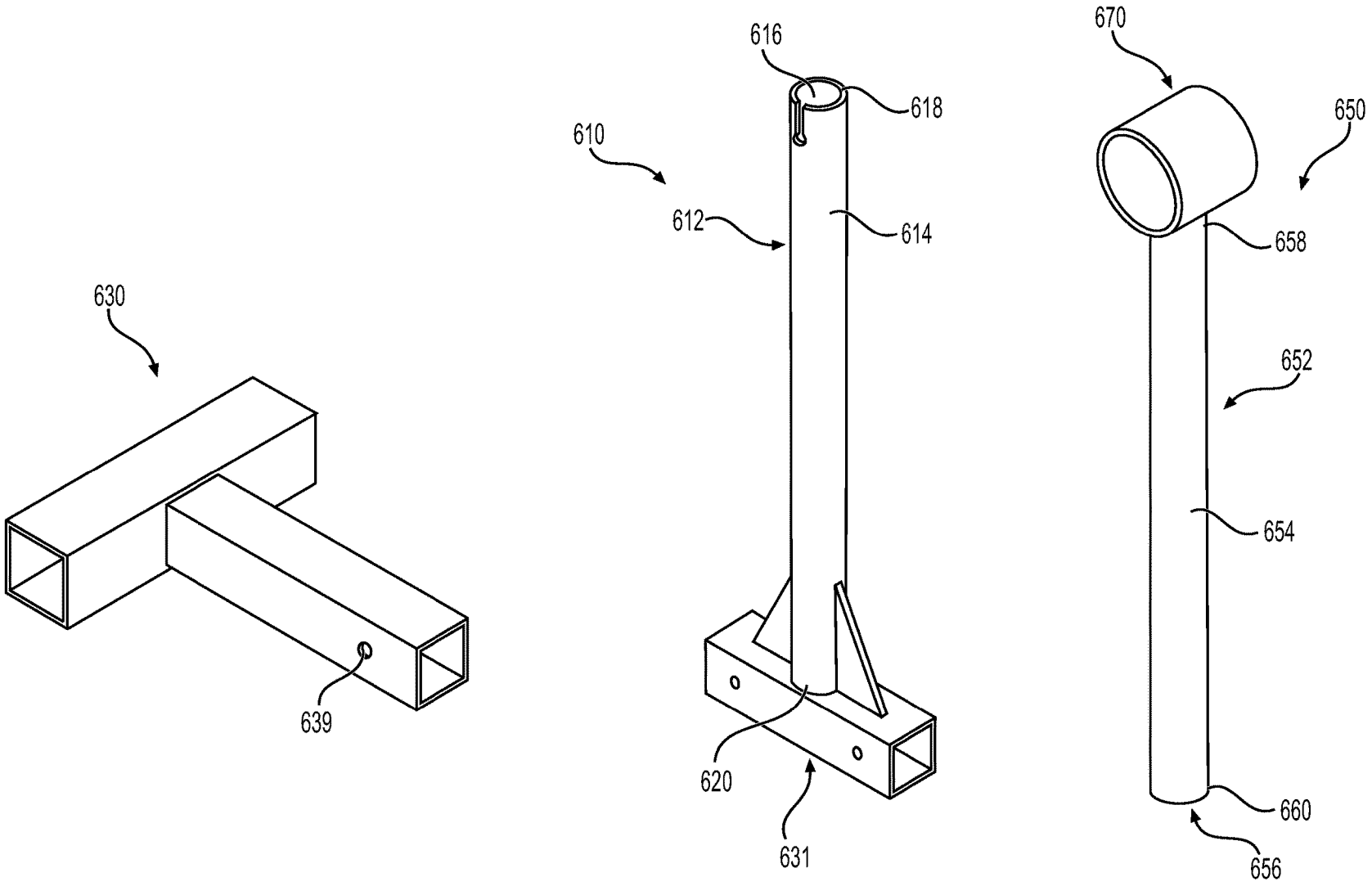
FIG. 17 is an exploded perspective view of the components of the spotting device of FIG. 14.

In another implementation of the spotting device 500, illustrated in FIGS. 9 and 10, the inner surface 516 of the base body 512 again defines the body opening 540, but the outer surface 554 of the arm body 552 now includes a radially slidable protrusion 584. The base body 512 defines three protrusion openings 586. The radially slidable protrusion 584 is biased toward a radially outward position by a spring force and is slidably disposable within each of the protrusion openings 586. The radially slidable protrusion 584 can be urged radially inwardly such that the radially slidable protrusion 584 is no longer disposed within a first protrusion opening 586. The arm body 552 is then free to be moved axially relative to the base body 512 such that the radially slidable protrusion 584 is aligned with another of the protrusion openings 586. Once aligned with a second protrusion opening 586, the biasing spring force of the radially slidable protrusion 584 causes the radially slidable protrusion 584 to move radially outwardly through the second protrusion opening 586 to prevent the axial movement of the arm body 552 relative to the base body 512.

Although the base body 512 shown in FIGS. 9 and 10 include three protrusion openings 586, in some implementations, the base body defines one, two, or any number of protrusion openings. In other implementations, the inner surface of the arm body defines the body opening, the outer surface of the arm body defines at least one protrusion opening, and the outer surface of the base body includes the radially slidable protrusion.

Also, in other implementations, the spotting device can include multiple radially slidable protrusions, both a radially slidable protrusion and a locking pin, or any other securing mechanism that is capable of preventing axial movement of the arm body relative to the base body such that spotting device can support a weightlifting barbell.

The implementations of spotting devices 100, 400, 500 shown in FIGS. 1-4 and 7-13, each weigh twenty-five pounds. The weight of each spotting device 100, 400, 500 can be added to the weight of the barbell and weights when calculating the total weight being lifted. In some implementations, the weight of each spotting device ranges from five pounds to forty-five or more pounds in standard increments (e.g., standard barbell weight increments, such as five pounds, ten pounds, twenty pounds, or forty-five pounds) based on the necessary strength of the spotting device for a given amount of weight the barbell and weights to be supported and the strength of the potential user. The arm, base, and locking pin can comprise a metal, plastic, any combination thereof, or any material strong enough to effectively support a weightlifting barbell.

FIGS. 14-17 show a spotting device 600 for supporting a weightlifting barbell, according to another implementation. The device 600 shown in FIGS. 14-17 is similar to the devices shown in FIGS. 1-13, except for the features discussed below.

The base body 612 of the base 610 of the device 600 shown in FIGS. 14-17 has a first end 618, a second end 620 opposite and spaced apart from the first end 618, an outer surface 614 extending between the first end 618 and the second end 620, and an inner surface 616 spaced radially inwardly from the outer surface 614. The arm body 652 of the arm 650 also has a first end 658, a second end 660 opposite and spaced apart from the first end 658, an outer surface 654 extending between the first end 658 and the second end 660, and an inner surface 656 spaced radially inwardly from the outer surface 654. The arm 650 has a coupler 670 coupled to the first end 658. The base body 612 has a circular cross-sectional shape in a plane perpendicular to the base longitudinal axis 628, and the arm body 652 of the arm 650 has a circular cross-sectional shape in a plane perpendicular to the arm longitudinal axis 668. The first end 618 of the base body 612 defines a body opening 640 that also has a circular cross-sectional shape in the plane perpendicular to the base longitudinal axis 628. The arm body 652 has an outer diameter sized such that the arm body 652 is slidably disposable within the body opening 640. The circular cross-sections of the base body 612 and arm body 652 are stronger than a square cross-section by weight, providing for a strong but lighter weight device.

In other implementations, the second end of the arm body defines the body opening having a circular cross-sectional shape in the plane perpendicular to the arm longitudinal axis, and the base body has an outer diameter sized such that the base body is slidably disposable within the body opening.

Unlike the devices shown in FIGS. 1-13, the device 600 shown in FIGS. 14-17 does not include a locking pin. The device 600 shown in FIGS. 14-17 includes a locking clamp 626 fixedly coupled to the first end 618 of the base body 612. The locking clamp 626 includes a post clamp axially aligned with the base opening 640 defined by the first end 618 of the base body 612. The locking clamp 626 extends circumferentially around the outer surface 654 of the arm body 652 when the arm body 652 is disposed within the body opening 640. The locking clamp 626 includes a cam lock 666 that is actuatable to reduce the inner circumferential length of the locking clamp 626 such that the locking clamp 626 is releasably couplable to the arm body 652 when the second end 660 of the arm body 652 is disposed within the body opening 640. The locking clamp 626 can be used to couple the arm body 652 to the base body 612 at any desired axial position of the arm body 652 relative to the base body 612 such that the distance from the central axis 676 of the coupler 670 of the arm 650 to the feet 630 of the base 610 is selectively variable.

Although the locking clamp 626 shown in FIGS. 14-17 is a post clamp, in other implementations, the device can include a locking clamp that is any type of clamp capable of releasably coupling the arm body to the base body. In implementations in which the arm body defines the base opening, the locking clamp is fixedly coupled to the second end of the arm body and is releasably couplable to the base body. In some implementations, the device can include any other locking device disclosed herein.

The base 610 of the device 600 also includes a base hub 632 for coupling the base body 612 to the two feet 630. The base hub 631 has a first side wall 632, a second side wall 633 opposite and spaced apart from the first side wall 632, a first hub end 634, and a second hub end 635 opposite and spaced apart from the first hub end 634. The first side wall 632 defines a base hub opening 636, the first hub end 634 defines a first hub end opening 637, and the second hub end 635 defines a second hub end opening 638. The base hub opening 636 is sized such that the second end 620 of the base body 612 is disposable within the base hub opening 636. When the second end 620 of the base body 612 is disposed within the base hub opening 636, the second end 620 of the base body 612 can abut the second side wall 633 of the base hub 631 to distribute the forces exerted on the base body 612 directly to the ground. Because the force from the base body 612 is distributed to the ground, the two feet 630 of the base 610 do not suffer as much from wear and are used mostly for stability.

The base 610 of the device 600 shown in FIGS. 14-17 also includes two support brackets 642. Each of the two support brackets 642 are coupled to the outer surface 614 of the base body 612 and to a portion of the first side wall 632 of the base hub 631. The support brackets 642 provide stability against any torque exerted on the base body 612 to strengthen the coupling of the base body 612 to the base hub 631.

The first hub end opening 637 and the second hub end opening 638 of the base hub 631 are each sized such that one of the two feet 630 can be disposed within each of the first hub end opening 637 and the second hub end opening 638. The base hub 631 defines fastener openings 642 that are alignable with fastener openings 642 defined by each of the feet 630 when the feet 630 are disposed within the first hub end opening 637 and the second hub end opening 638. A fastener can be disposed within the aligned fastener openings 639 defined by the base hub 631 and feet 630 to couple the feet 630 to the base hub 631. This allows the feet 630 to be decoupled from the base hub 631 for more compact storage, shipping, etc.

The base 610 of the device 600 shown in FIGS. 14-17 also includes non-slip, protective pads 644 on the bottom surfaces of the second side wall 633 of the base hub 631 and of the feet 630. The pads 644 reduce damage to surfaces on which the device 600 is set. The pads 630 also reduce slipping of the device 600 when the device 600 is set on a surface.

Although the base 610 of the device 600 shown in FIGS. 14-17 includes two feet 630, in other implementations, the base of the device can include any number of feet and the base hub can include any number of ends each defining any number of openings in which the feet can be disposed. In some implementations, the base hub defines openings in any orientation to allow for the feet to extend in any predetermined configuration. Although the base body 612 shown in FIGS. 14-17 is permanently coupled to the base hub 631, in other implementations, the base body and base hub are separate components and are releasably couplable to each other. The feet 630 and base hub 631 shown in FIGS. 14-17 are separate components and are releasably couplable, but in other implementations, the feet and the base hub are permanently coupled to each other.

A number of example implementations are provided herein. However, it is understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A spotting device for supporting a weightlifting barbell, the device comprising:

a base having a base body, at least one foot, and a base longitudinal axis, wherein the base body has a first end and a second end opposite and spaced apart from the first end of the base body, wherein the at least one foot is coupled to the second end of the base body; and an arm having an arm body, a coupler, and an arm longitudinal axis, wherein the arm body has a first end and a second end opposite and spaced apart from the first end of the arm body, wherein the first end of the arm body is coupled to the coupler, wherein the coupler is couplable to a portion of a weightlifting barbell, wherein one of the first end of the base body and the second end of the arm body defines a body opening extending at least partially through the one of the base body or the arm body, and an other of the second end of the arm body and the first end of the base body is slidably disposed within the body opening, wherein the coupler includes two coupler protrusions and a central axis, wherein each coupler protrusion partially extends circumferentially around the central axis of the coupler, wherein the coupler protrusions are biased toward a radially inward position and are urgable toward a radially outward position; and wherein the coupler protrusions are integrally formed with the coupler, and wherein the coupler is integrally coupled to the arm body.

2. The device of claim 1, wherein the coupler defines a coupler opening and a central axis, wherein the coupler opening extends through the coupler perpendicularly to the arm longitudinal axis.

3. The device of claim 2, wherein the coupler opening is circular.

4. The device of claim 2, wherein the base and arm are slidably coupled between a first position and a second position, wherein the device has a first length as measured from the central axis of the coupler to the at least one foot in the first position and a second length as measured from the central axis of the coupler to the foot in the second position, wherein the first length is at least two feet and the second length is five feet or less.

5. The device of claim 1, further including a locking pin, wherein the base and the arm each define at least one locking pin opening, and wherein each locking pin is disposable within the at least one locking pin opening of the base and the at least one locking pin opening of the arm such that the arm and the base are coupled by the locking pin.

6. The device of claim 1, wherein the other of the arm body and the base body includes a radially slidable protrusion, the radially slidable protrusion being biased toward a radially outward position by a spring force and is urgable toward a radially inward position, and the one of the base body and the arm body defines at least one protrusion opening.

7. The device of claim 1, wherein a guide protrusion extends radially inwardly from the body opening and the other of the arm body and the base body defines a longitudinally extending guide slot, and the guide protrusion is slidably disposable within the guide slot.

8. The device of claim 1, wherein the at least one foot includes at least two feet.

9. The device of any one of claim 8, wherein the at least one foot includes three or more feet.

10. The device of claim 1, wherein the device comprises a plastic.

11. The device of claim 1, wherein the device comprises a metal.

12. The device of claim 1, further including a locking clamp fixedly coupled to the one of the first end of the base body and the second end of the arm body, wherein the locking clamp is releasably couplable to the other of the second end of the arm body and the first end of the base body when the other of the second end of the arm body and the first end of the base body is disposed within the body opening.

13. The device of claim 12, wherein the locking clamp comprises a post clamp.

14. The device of claim 1, wherein the base further includes a base hub, wherein the second end of the base body is coupled to the base hub and the at least one foot is coupled to the base hub.

15. The device of claim 14, wherein the at least one foot is releasably couplable to the base hub.

16. The device of claim 14, wherein the base hub has a first side wall and a second side wall opposite and spaced apart from the first side wall, wherein the first side wall defines a base hub opening, wherein the second end of the base body is disposed within the base hub opening such that the second end of the base body abuts the second side wall.

17. The device of claim 1, wherein the base body has a circular cross-sectional shape in a plane perpendicular to the base longitudinal axis, wherein the arm body has a circular cross-sectional shape in a plane perpendicular to the arm longitudinal axis.

* * * * *